US005874896A

United States Patent [19]

Lowe et al.

[11] Patent Number: 5,874,896

[45] Date of Patent: Feb. 23, 1999

[54] ELECTRONIC ANTI-SHOPLIFTING SYSTEM EMPLOYING AN RFID TAG

[75] Inventors: Peter R. Lowe, Colorado Springs, Colo.; Donald G. Small, Jr., San Juan Capistrano, Calif.

[73] Assignee: Palomar Technologies Corporation, Carlsbad, Calif.

[21] Appl. No.: 703,045

[22] Filed: Aug. 26, 1996

[51] Int. Cl.[6] ..... G08B 13/187

[52] U.S. Cl. ..... 340/572; 340/825; 340/825.36; 340/825.37

[58] Field of Search ..... 340/572, 825, 340/825.36, 825.37

[56] References Cited

U.S. PATENT DOCUMENTS

| | | | |
|---|---|---|---|
| 4,399,437 | 8/1983 | Falck et al. | 340/825.54 |
| 4,656,463 | 4/1987 | Anders et al. | 340/541 |
| 4,730,188 | 3/1988 | Milheiser | 340/825 |
| 5,214,409 | 5/1993 | Beigel | 340/572 |
| 5,218,343 | 6/1993 | Stobbe et al. | 340/572 |
| 5,499,017 | 3/1996 | Beigel | 340/572 |

OTHER PUBLICATIONS

"e5550 Standard R/W Identification Preliminary Information", Temic Telefunken Semiconductors, pp. 93–106, Dec. 8, 1995.

"e5550 Standard R/W Identification IC Preliminary Product Features", Temic Eurosil, Oct. 13, 1994.

*Primary Examiner*—Glen Swann

*Attorney, Agent, or Firm*—Rodney F. Brown

[57] ABSTRACT

An electronic anti-shoplifting system monitors articles of merchandise in a sales outlet to deter shoplifting. The system is provided with transponder tags connected to the articles of merchandise. A tag exciter is positioned at an exit leading from the sales outlet and generates an RF surveillance excitation signal. If a customer carries an article through the exit without removal authorization due to failure to pay for the article, the transponder tag is activated, being powered by the RF surveillance excitation signal as the customer passes the tag exciter. The activated transponder tag generates an RF surveillance response signal that triggers an alarm. If the customer has removal authorization as the result of paying for the article, the transponder tag is reprogrammed to modify the operational data stored therein. The operational data typically includes data to alter the frequency of an RF response signal generated by the transponder tag, the frequency of an RF excitation signal to which the transponder tag responds, and/or the type of modulation used by the transponder tag to generate an RF response signal. Sales data, such as the purchase price and date of purchase, is also stored in the transponder tag. When the customer exits the sales outlet after the transponder tag is reprogrammed, the transponder tag does not generate the RF surveillance response signal that triggers the alarm. However, the sales data stored in the transponder tag can be accessed by the clerk of the sales outlet at a later date.

28 Claims, 3 Drawing Sheets

100
58
Modulator
120
Memory
140
Input Register
144
Voltage Generator
150
Mode Register
136
Controller
138
Write Decoder
124
Bitrate Generator
128
Analog Front End
110
118
116
186
188
190
60
Exciter/ Reader/ Writer
184
Alarm
75
182
Exciter
70

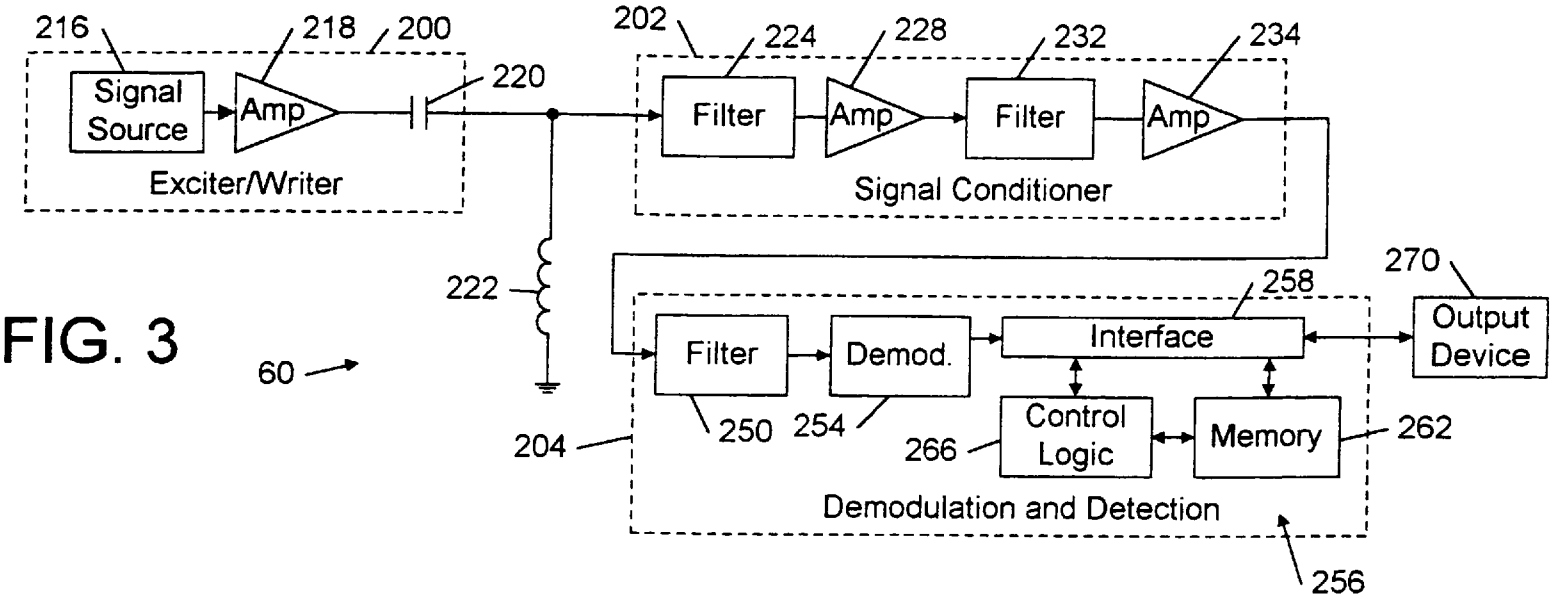
FIG. 3
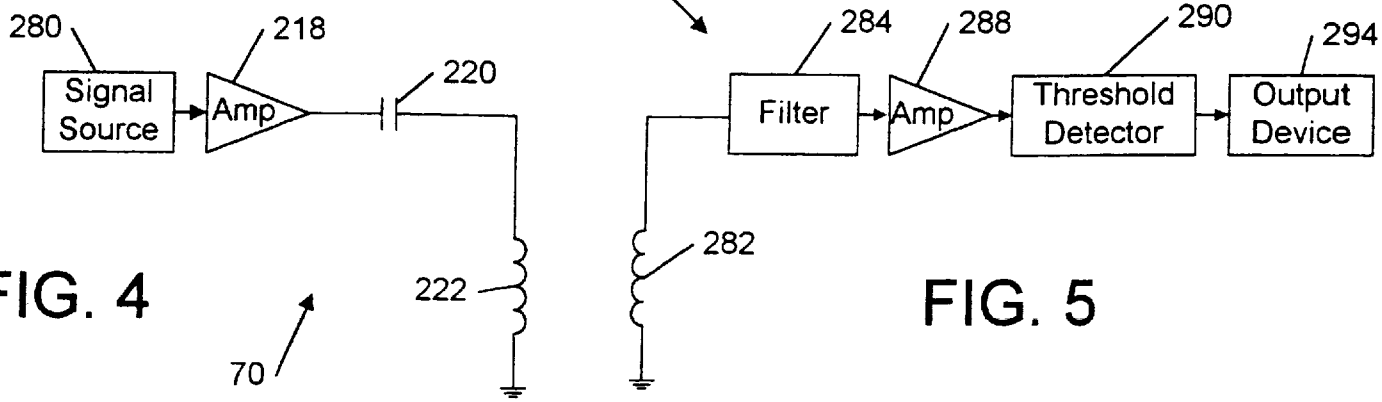
FIG. 5
FIG. 4

ELECTRONIC ANTI-SHOPLIFTING SYSTEM EMPLOYING AN RFID TAG

TECHNICAL FIELD

The present invention relates generally to electronic surveillance of merchandise in sales outlets.

BACKGROUND OF THE INVENTION

Shoplifting in sales outlets, and particularly in retail sales outlets, is a significant problem adversely affecting both sellers and consumers. It is estimated that retail sellers lose between $10 and $12 billion worth of merchandise annually due to shoplifting and spend an additional $7 to $10 billion on anti-shoplifting measures, including security devices and personnel to prevent shoplifting. To offset the costs of shoplifting, retail sellers pass these costs on to consumers in the form of higher prices on merchandise. It is estimated that each household in the United States pays retail sellers approximately $200 per year in increased retail prices for merchandise due to the costs of shoplifting.

To deter shoplifting, some sales outlets employ electronic article surveillance (EAS) systems that include transponder tags attached to each article of merchandise in the sales outlet. EAS systems further include one or more electronic readers positioned at exits from the sales outlet to detect the transponder tags. When a customer purchases an article, the transponder tag is disabled or removed from the article and the customer passes by the reader and out the exit of the sales outlet without sounding an alarm. When a shoplifter attempts to remove an article from the sales outlet without paying, the reader detects the transponder tag that has not been disabled or removed from the article and sounds the alarm. Sales or security personnel in the sales outlet are alerted by the alarm, enabling them to apprehend the shoplifter and recover the merchandise.

Although EAS systems are effective in reducing losses incurred by sales outlets due to theft of merchandise without payment, retail sales outlets employing EAS systems remain susceptible to other forms of shoplifting. Many retail sellers allow customers to freely return merchandise purchased from the sales outlet, even in the absence of proof of purchase, if the article being returned is carried by the sales outlet. Some customers, however, purchase merchandise at reduced sale prices from a retail sales outlet and return the merchandise to the same sales outlet for exchange or refund, claiming to have paid full price for the merchandise. If the seller refunds the full price, the seller loses the amount in excess of the purchase price in addition to the cost of processing the returned merchandise. Other retail sellers provide price guarantees having time limits. If a customer purchases an article of merchandise from a seller and subsequently discovers that the article is sold elsewhere at a lower price or that the original seller has dropped the price of the article after the customer's purchase date, but before the expiration of the price guarantee time limit, the customer is entitled to a refund from the seller of an amount at least equal to the difference between the purchase price and the lower price. Some customers, however, attempt to recover a refund under the price guarantee after expiration of the time limit. Still other customers remove merchandise from one sales outlet without paying for the merchandise and attempt to return the merchandise to another sales outlet that sells the same merchandise for a cash refund.

Accordingly, it is an object of the present invention to generally improve electronic anti-shoplifting systems. It is another object of the present invention to provide an electronic anti-shoplifting system that deters shoplifting and deters customers from returning sale-priced merchandise for full price. It is another object of the present invention to provide an electronic anti-shoplifting system that deters shoplifting and deters customers from returning merchandise after a time-limited price guarantee expires. It is another object of the present invention to provide an electronic anti-shoplifting system that deters customers from stealing merchandise from one sales outlet and returning the merchandise for a cash refund to another sales outlet that sells the same merchandise. It is still another object of the present invention to provide an electronic anti-shoplifting electronic system that is small in size and relatively inexpensive to manufacture. These objects and others are achieved by the present invention described hereafter.

SUMMARY OF THE INVENTION

The present invention is a method and apparatus for monitoring the removal of articles of merchandise from a controlled area, such as a sales outlet, to deter shoplifting of merchandise from the sales outlet. The apparatus includes a plurality of transponder tags and a tag exciter. The transponder tags are connected to the articles of merchandise on display to customers in the sales outlet. The tag exciter is positioned at the customer exit leading from the sales outlet and generates an RF surveillance excitation signal that is transmitted to the transponder tag as it passes by the tag exciter through the exit. If a customer carries an article of merchandise through the exit without removal authorization due failure to pay for the article, the transponder tag connected to the article is activated, being powered by the RF surveillance excitation signal from the tag exciter. The activated transponder tag generates an RF surveillance response signal in response to the RF surveillance excitation signal and the RF surveillance response signal triggers an alarm.

If the customer obtains removal authorization by paying for the article, the transponder tag is reprogrammed to modify the operational data stored therein. The operational data typically includes data to alter the frequency of the RF response signal generated by the transponder tag, the frequency of the RF excitation signal to which the transponder tag responds, and/or the type of modulation used by the transponder tag to generate the RF response signal. Sales data, such as the purchase price and date of purchase, is also stored in the transponder tag. When the customer exits the sales outlet after the transponder tag is reprogrammed, the transponder tag does not generate the RF surveillance response signal that triggers the alarm.

The present invention will be further understood, both as to its structure and operation, from the accompanying drawings, taken in conjunction with the accompanying description, in which similar reference characters refer to similar parts.

BRIEF DESCRIPTION OF THE DRAWINGS

FIG. 3 is a block diagram and electrical schematic of the exciter/reader/writer circuit for the anti-shoplifting electronic system of FIGS. 1 and 2.

FIG. 4 is a block diagram and electrical schematic of the exciter for the anti-shoplifting electronic system of FIGS. 1 and 2.

FIG. 5 is a block diagram and electrical schematic of the alarm for the anti-shoplifting electronic system of FIGS. 1 and 2.

DESCRIPTION OF PREFERRED EMBODIMENTS

Radio frequency (RF) transponder systems are used to communicate between remote locations without direct electrical contact therebetween. RF transponder systems generally include an exciter/reader (ER) and a transponder, otherwise termed an RF identification (RFID) tag. The ER generates an RF excitation signal and transmits it to the transponder that is energized thereby, causing the transponder to generate an identification signal or other data signal and transmit it back to the ER at a particular frequency. RF transponder systems are commonly used to identify or indicate the presence of an object to which the RFID tag is connected or to transmit information relating to a physical condition such as the air pressure of a tire or the temperature of a fluid in a container.

Electronic article surveillance (EAS) systems include transponder tags attached to articles of merchandise in a sales outlet. The EAS systems also include readers positioned at the exits leading from the sales outlet. When a customer attempts to shoplift merchandise from the sales outlet by removing an article without paying for it, the reader generates an excitation signal that powers the transponder tag. The transponder tag generates a response signal that triggers an alarm associated with the reader or a stand-alone alarm. If a customer purchases the merchandise, the transponder tag is disabled or removed. The present invention combines the desirable features of both EAS systems and RF transponder systems to provide an electronic anti-shoplifting system.

Figure 1:
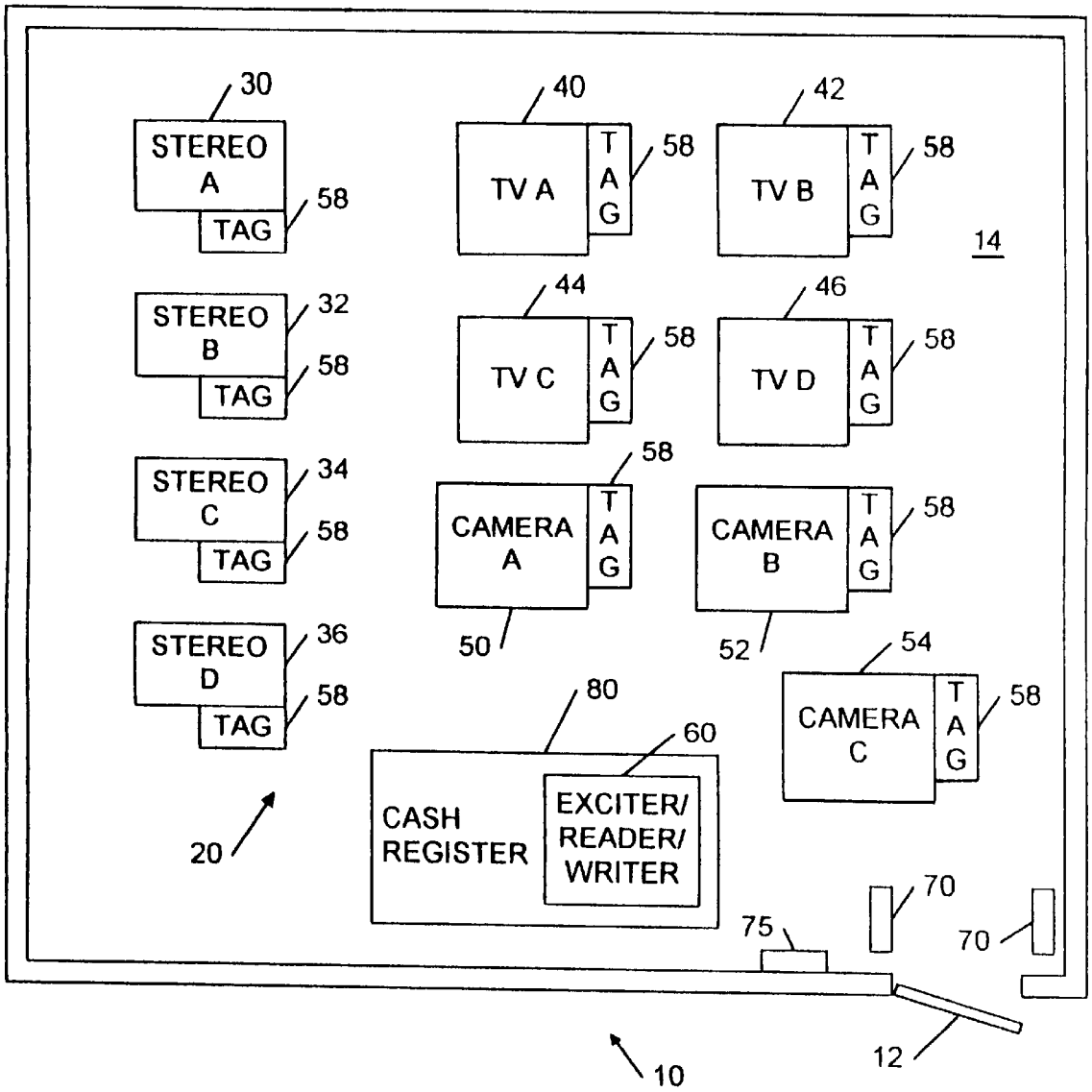
FIG. 1 is a block diagram of an anti-shoplifting electronic system according to the present invention in a sales outlet.

Referring now to FIG. 1, an electronic anti-shoplifting system according to the present invention is shown. A sales outlet generally designated 10 includes one or more exits such as a doorway 12 through which customers depart the sales outlet 10.

The sales outlet 10 includes retail space 14 in which articles of merchandise generally designated 20 are displayed for sale to the customers. For example, the articles of merchandise may include multiple personal stereo systems 30, 32, 34, and 36, miniature portable televisions 40, 42, 44 and 46, and cameras 50, 52, and 54. Skilled artisans can appreciate that the articles may include any type of merchandise. Skilled artisans can further appreciate that, in addition to sales outlets, the present electronic anti-shoplifting device has application to substantially any controlled area. Transponder tags 58 are physically connected by a fastener (not shown) to the articles of merchandise 20. Preferably, the fastener cannot be removed without a special removal tool or key not available to the general public. Such fasteners are known in the art and are not be described further herein.

The electronic anti-shoplifting system includes the transponder tags 58, one or more exciter/reader/writer (ERW) circuits 60, one or more exciters 70 and one or more alarms 75. The ERW circuit 60 is preferably located at the point of sale, such as a cash register 80. The exciter 70 is preferably located at the exit 12 leading from the sales outlet 10 such that customers must pass by the exciter 70 with any articles 20 in their possession before exiting the sales outlet 10. The alarm 75 is located near the exciter 70. The exciter 70 generates and transmits an RF surveillance excitation signal. The transponder tag 58 receives the RF surveillance excitation signal and, in the absence of a purchase authorization, responds thereto by generating and transmitting an RF surveillance response signal. The alarm 75 receives the RF surveillance response signal. Alternately an exciter/reader can be employed to perform both functions of generating the RF surveillance excitation signal and receiving the RF surveillance response signal. Skilled artisans can appreciate that the sales outlet 10 may include additional exits 12 associated with additional exciters 70, alarms 75, cash registers 80 and/or ERW circuits 60.

Figure 2:
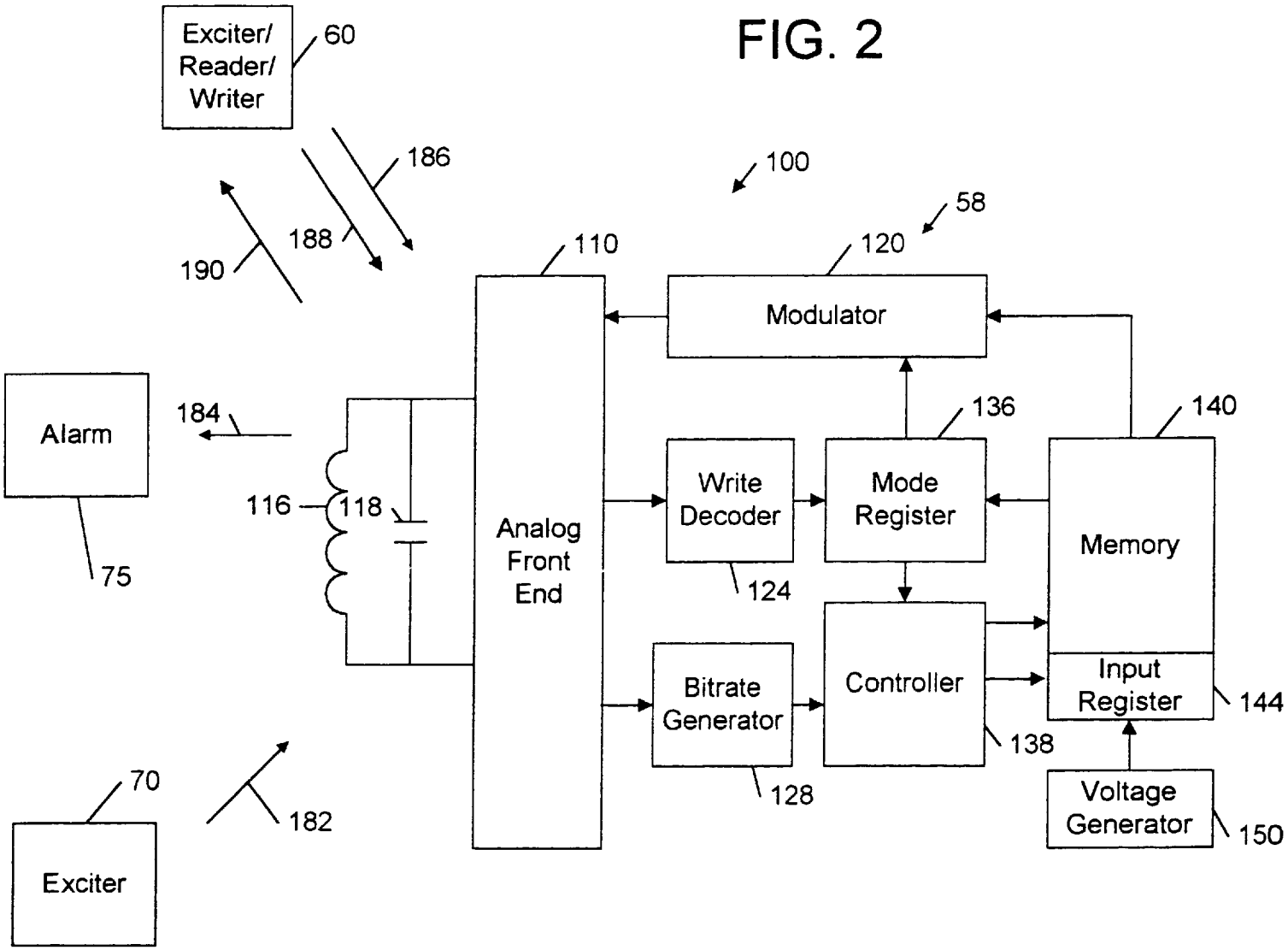
FIG. 2 is a block diagram and electrical schematic of an exciter/reader/writer circuit, an exciter, a transponder tag and an alarm for the anti-shoplifting electronic system of FIG. 1.

Referring to FIG. 2, a preferred embodiment of the electronic anti-shoplifting system is shown and generally designated 100. The electronic anti-shoplifting system 100 includes the ERW circuit 60, the exciter 70, the alarm 75 and the transponder tag 58. The transponder tag 58 includes an analog front end 110 having inputs connected to an antenna coil 116, a capacitor 118, and a modulator 120 and having outputs connected to a write decoder 124 and a bitrate generator 128. An output of the write decoder 124 is connected to a first input of a mode register 136. The mode register 136 has outputs coupled to the modulator 120 and a logic controller 138. A second input of the mode register 136 is coupled to a first output of the memory 140. The first and second outputs of the controller 138 are coupled to a first input of the memory 140 and an input register 144 of the memory 140, respectively. A voltage generator 150 has an output coupled to the input register 144.

The analog front end 110 generates power from the current induced on the antenna coil 116 by the RF reading, writing, or surveillance excitation signal, which is a magnetic field produced by the ERW circuit 60 or the exciter 70. The analog front end 110 controls the bidirectional data communications with the ERW circuit 60, the exciter 70, and the alarm 75. The analog front end 110 rectifies the AC coil voltage to generate a DC supply voltage to power the transponder tag 58 and extracts a clock signal from the AC coil voltage. By way of example, the analog front end 110 selectively switches a load across opposite nodes of the antenna coil 116 when transmitting the response signal from the transponder tag 58 to the ERW circuit 60 or the alarm 75 during the reading or surveillance modes. The analog front end 110 also detects a field gap that occurs when the ERW circuit 60 is attempting to write information into the memory 140 during the writing mode. The controller 138 loads the mode register 136 with operational data from the memory 140 after power-on and during reading to minimize errors. The controller 138 controls reading and writing access to the memory 140. If the password is enabled, the controller 138 compares a password transmitted by the ERW circuit 60 to the password stored in memory 140 to grant or deny reading or writing access to the data stored in the memory 140.

The bitrate generator 128 allows the selection of bitrates which are a fractional portion of the frequency of the RF excitation signal. Typically, the bitrate generator allows selection of the following bitrates: RF/8, RF/16, RF/32, RF/40, RF/50, RF/64, RF/100, and RF/128, where RF equals the frequency of the RF excitation signal. With slight modification of the bitrate generator 128, additional bitrates of RF/2 and RF/4 are provided to maximize signal power of the RF surveillance response signal during the surveillance mode as described hereafter. The write decoder 124 determines whether a write data stream from the ERW circuit 60 is valid. The voltage generator 150 generates a supply voltage for programming the memory 140 during a write signal. The mode register 136 stores the mode data from the memory 140 and periodically refreshes the mode data during the reading mode. The modulator 120 allows selection of various different modulation schemes for the reading response signal including: frequency shift key (FSK); phase shift key (PSK); Manchester; biphase; and combinations thereof. The memory 140 is preferably EEPROM.

In operation, a customer enters the sales outlet 10. If the customer attempts to shoplift an article of merchandise, such as the camera 50, the exciter 70 generates an RF surveillance excitation signal 182 that triggers the transponder tag 58. The transponder tag 58, that is connected to the camera 50 and is in a surveillance mode, generates an RF surveillance response signal 184. In any case, the alarm 75 receives the RF surveillance response signal 184 and generates a visual or audible signal to alert security personnel. Alternately, an exciter/reader receives the RF surveillance response signal 184 from the transponder tag 58 and triggers an alarm integral with the exciter/reader that alerts security personnel. The RF surveillance response signal 184 is preferably transmitted free of any data when the transponder tag 58 is in the surveillance mode. The RF surveillance signal 184 activates the alarm simply by its presence and the alarm remains inactive when the RF surveillance signal 184 is absent. The RF surveillance signal 184 is preferably transmitted to the alarm at as great a power level as possible to maximize the transmission range of the RF surveillance signal 184 and correspondingly the real range of the ERW circuit 60. A relatively high power level is achieved by returning the RF surveillance signal 184 to the alarm at a single frequency corresponding to a selected bitrate preferably greater than RF/4 and more preferably a selected bitrate of RF/2.

If the customer purchases an article of merchandise such as the stereo 30, the customer selects the stereo 30 and brings the stereo 30 to the cash register 80. A sales clerk positions the transponder tag 58 attached to the stereo 30 adjacent the ERW circuit 60 and actuates a reprogramming mode that reprograms the transponder tag 58. During the reprogramming mode, the ERW circuit 60 generates an RF write excitation signal 186 received by the transponder tag 58. The RF write excitation signal 186 generated by the ERW circuit 60 actuates a writing circuit in the transponder tag 58 that writes sales data and/or operational data contained in the write signal into the non-volatile memory of the transponder tag 58.

The sales data preferably includes the time and date of sale, name of customer and the purchase price. The sales data may also include merchandise identification data or other descriptive information concerning the article of merchandise. In the example above, the sales data written into the transponder tag 58 coupled to the stereo 30 includes the name of customer the purchase price, the time and date of sale, the model number, the manufacturer, or other information concerning the stereo 30. Preferably, the write circuit of the transponder tag 58 requires a password. The ERW circuit 60 outputs the password as an initial portion of the write excitation signal 186. The writing circuit of the transponder tag 58 will not write the sales data into the non-volatile memory of the transponder tag 58 before receiving the password.

During the reprogramming mode, operation of the transponder tag 58 is altered such that it is disabled relative to the exciter 70, but not relative to the ERW circuit 60. Consequently, when the customer exits the sales outlet 10 through one of the exits 12, the transponder tag 58 and the exciter 70 do not trigger the alarm 75. To that end, the write signal generated by the ERW circuit 60 includes operational data that changes the operation of the transponder tag 58. Preferably the operational data contained in the write signal changes the frequency of the RF response signal, the frequency of the RF excitation signal to which the transponder tag 58 responds, and/or the type of modulation used by the transponder tag 58 to generate the RF response signal. After the programming mode is completed and the transponder tag 58 is in the data mode, the transponder tag 58 does not respond when passing through the exciter 70. Therefore, the alarm is not erroneously triggered.

When a customer subsequently returns a previously purchased article of merchandise, the sales clerk actuates a reading mode of the ERW circuit 60. The ERW circuit 60 generates a reading excitation signal 188 received by the transponder tag 58. The transponder tag 58 is powered by the reading excitation signal 188 and generates a reading response signal 190 including the sale data previously stored in the non-volatile memory of the transponder tag 58. The ERW circuit 60 receives the reading response signal 190 from the transponder tag 58. The cash register 80 and/or the ERW circuit 60 outputs the sales data to the sales clerk.

As can be appreciated, the sales clerk reviews the sales data before deciding whether a refund is authorized and the appropriate amount of the refund. If the article was on sale when the customer purchased the article, the sales clerk will know the reduced sale price and will not refund the full price of article. If the refund is in response to a time-limited price guarantee, the sales clerk knows when the article was purchased and will not provide refunds on articles where the time limit of the price guarantee has expired. If the article lacks a transponder tag 58, the sales clerk can reasonably conclude that the article was not purchased from the sales outlet 10 and void a refund.

In a preferred embodiment, the transponder tag 58 includes a Temic e5550 Read/Write Identification Integrated Circuit (IDIC®) available from Temic Eurosil, Eching, Germany. Details of the Temic e5550 IDIC® are provided in "e5550 Standard R/W Identification IC Preliminary Product Features" dated Oct. 13, 1994 and in "e5550 Standard R/W Identification IC Preliminary Information" dated Dec. 12, 1995, both of which are incorporated herein by reference.

A suitable ERW circuit is a conventional reader modified to modulate its excitation in accordance with the method described in the above-cited references that can be mechanically configured for mounting in various types of environments. Referring to FIG. 3, the ERW circuit is shown and generally designated 60. The ERW circuit 60 has three main functional units: an exciter/writer 200, a signal conditioner circuit 202, and a demodulation and detection circuit 204.

The exciter/writer circuit 200 consists of an AC signal source 216 followed by a power amplifier 218 that amplifies the signal generated by the AC signal source to provide a high current, high voltage reading or writing excitation signal to a capacitor 220 and an antenna coil 222. The inductance of the antenna coil 222 and the capacitance of the capacitor 220 are selected to resonate at the excitation signal frequency so that the voltage across the antenna coil 222 is greater than the voltage output of the power amplifier 218. The AC signal source 216 provides the reading or writing excitation signal that can include an identification code for the transponder Tag 58 and/or write data to be written into the memory 44 of the transponder tag 58.

The signal conditioner circuit 202 is also coupled to the antenna coil 222 and serves to amplify the RF reading response signal generated by the transponder tag 58. The signal conditioner circuit 202 filters out the RF reading excitation signal frequencies as well as other noise and undesired signals outside of the frequency range of the transponder tag signals. The signal conditioner circuit 202 includes a first filter 224 that passes the RF reading response signal frequency returned from the transponder tag 58. A first amplifier 228 increases the signal strength of the signal output by the first filter 224. A second filter 232 passively excludes the high energy at the excitation frequency. A second amplifier 234 increases the signal strength of the signal output by the second filter 232. Preferably the filters 224 and 232 include abandpass filter and a bandstop filter. Skilled artisans can appreciate that the relative positions of the first and second filters can be switched or a higher order filter providing both bandpass and bandstop filtering functions can be employed. The first and second amplifiers 228 and 234 can also be combined into a single amplifier.

The amplified output of the signal conditioner circuit 202 is input to a filter 250 of the demodulation and detection circuit 204 that further reduces the excitation signal energy. Preferably the filter 250 is a low pass filter. The demodulation and detection circuit 204 also includes a demodulation circuit 254 and a microcomputer generally designated 256. The microcomputer 256 includes an input/output interface 258, a memory 262, and a microprocessor or control logic 266. The demodulation circuit 254 is typically a FSK demodulator that includes a phase-locked loop circuit configured as a tone detector. The demodulation circuit 254 and the microcomputer 256 extract data from the response signal. To extract the data, digital signals are generated when the return signal from the transponder tag 58 shifts between two frequencies. The timing of the transitions of the digital signals between the logic levels or frequencies is detected. The information obtained by the microcomputer 256 can be stored in the memory 262 or transferred to an output device 270 such as a display, a printer, a network, another computer or other devices or storage media.

Referring to FIG. 4, the exciter 70, which is a simplified form of the ERW circuit 60, is illustrated. The exciter 70 includes a signal source 280 that generates an RF surveillance excitation signal, the power amplifier 218, the capacitor 220 and the antenna 222. Referring to FIG. 5, the alarm 75 includes an inductive coil 282, a bandpass filter 284 and a power amplifier 288 that pass and amplify the RF surveillance response signal generated by the transponder tag 58. A threshold detector 290 generates an alarm trigger signal to an output device 294 if the surveillance response signal exceeds the preset threshold of the threshold detector 290. The output device 294 is preferably a visual or audible alarm. The exciter 70 and the alarm 75 can be combined into a signal exciter/reader or alarm circuit.

Applicant has illustrated the method according to the present invention with the exemplary electronic anti-shoplifting system described above. Skilled artisans will realize that other circuits can be substituted for the transponder tag 58, ERW circuit 60, exciter 70, and alarm 75 described above without departing from the teachings of the present invention. For example, instead of using contactless reprogramming of the transponder tag 58 described above, programming through direct contact can be used as taught in U.S. Pat. No. 4,730,188 to Milheiser which is incorporated herein by reference. Contactless programming can be performed using other methods. For example, several different methods of contactless programming an RF transponder are known including "Coded Information Arrangement", U.S. Pat. No. 4,399,437 to Falck et al. and commonly assigned patent applications entitled "Contactless Programmable Radio Frequency Transponder", U.S. Ser. No. 08/540,631, filed Oct. 11, 1995, "RF Identification Tag and Contactless Method of Programming the Same", U.S. Ser. No. 08/514,712, filed Aug. 14, 1995, and "High Field Programmable Transponder System and Method", U.S. Ser. No. 08/316,653, filed Sep. 30, 1994, now abandoned all of which are incorporated herein by reference. Still other methods of contactless programming will be apparent to skilled artisans.

While the foregoing preferred embodiments of the invention have been described and shown, it is understood that alternatives and modifications, such as those suggested and others, may be made thereto and fall within the scope of the invention.

We claim:

1. A method for monitoring the removal of an article of merchandise from a sales outlet comprising:

connecting a transponder tag to an article of merchandise in a sales outlet;

positioning a tag exciter at an exit leading from said sales outlet;

generating an RF surveillance excitation signal with said tag exciter;

activating said transponder tag with said RF surveillance excitation signal when said transponder tag passes said tag exciter in the absence of removal authorization for said article;

generating an RF surveillance response signal with said activated transponder tag in response to said RF surveillance excitation signal;

triggering an alarm in response to said RF surveillance response signal; and reprogramming said transponder tag and storing sales data in said transponder tag upon removal authorization for said article, wherein said reprogrammed transponder tag does not generate said RF surveillance response signal triggering said alarm when said transponder tag passes said tag exciter.

2. The method recited in claim 1 wherein said reprogramming step further comprises:

generating an RF write excitation signal including operational data and said sales data;

activating said transponder tag with said RF write excitation signal;

modifying operation of said transponder tag with said operational data; and storing said sales data in a non-volatile memory associated with said transponder tag.

3. The method recited in claim 1 wherein said sales data includes the purchase price of said article.

4. The method recited in claim 1 wherein said sales data includes the purchase date of said article.

5. The method recited in claim 1 further comprising using an exciter/reader/writer circuit to reprogram said transponder tag.

6. The method recited in claim 1 wherein said operational data includes data altering the frequency of said RF surveillance response signal generated by said transponder tag.

7. The method recited in claim 1 wherein said operational data includes data altering the frequency of said RF surveillance excitation signal to which said transponder tag responds.

8. The method recited in claim 1 wherein said operational data includes data altering the type of modulation used by said transponder tag to generate said RF surveillance response signal.

9. The method recited in claim 1 wherein said RF surveillance response signal is substantially free of data.

10. The method recited in claim 1 wherein said RF surveillance response signal has a frequency of at least about one quarter the frequency of said RF surveillance excitation signal.

11. The method recited in claim 1 wherein said RF surveillance response signal has a frequency about equal to one half the frequency of said RF surveillance excitation signal.

12. An electronic anti-shoplifting system comprising:

a tag exciter positioned at an exit of a controlled area generating an RF surveillance excitation signal;

an exciter/reader/writer circuit generating an RF writing excitation signal containing operational and sales data and generating an RF reading excitation signal;

a plurality of transponder tags, each transponder tag connected to an article of merchandise located in the controlled area and each said transponder tag including a memory and a controller having a surveillance mode enabling said transponder tag to generate an RF surveillance response signal after receiving said RF surveillance excitation signal, a programming mode wherein said controller stores said operational and sales data in said memory, and a reading mode wherein said controller generates an RF reading response signal containing said sales data, wherein said exciter/reader/writer circuit receives said RF reading response signal and outputs said sales data to an output device; and an alarm for generating an alarm signal in response to said RF surveillance response signal.

13. The electronic anti-shoplifting system recited in claim 12 wherein said sales data includes the purchase price of said article.

14. The electronic anti-shoplifting system recited in claim 12 wherein said sales data includes the date of purchase of said article.

15. A method for monitoring the removal of an article from a controlled area comprising:

connecting a transponder tag to an article in a controlled area;

positioning a tag exciter at an exit leading from said controlled area;

generating an RF surveillance excitation signal with said tag exciter;

activating said transponder tag with said RF surveillance excitation signal when said transponder tag passes said tag exciter in the absence of removal authorization for said article;

generating an RF surveillance response signal with said activated transponder tag in response to said RF surveillance excitation signal;

triggering an alarm in response to said RF surveillance response signal; and reprogramming said transponder tag and storing transaction data in said transponder tag upon removal authorization for said article, wherein said reprogrammed transponder tag does not generate said RF surveillance response signal triggering said alarm when said transponder tag passes said tag exciter.

16. The method recited in claim 15 wherein said reprogramming step further comprises:

generating an RF write excitation signal including operational data and said transaction data;

activating said transponder tag with said RF write excitation signal;

modifying operation of said transponder tag with said operational data; and storing said transaction data in a non-volatile memory associated with said transponder tag.

17. The method recited in claim 15 wherein said transaction data includes the name of the person removing said article from said controlled area.

18. The method recited in claim 15 wherein said transaction data includes the removal date of said article from said controlled area.

19. The method recited in claim 15 further comprising using an exciter/reader/writer circuit to reprogram said transponder tag.

20. The method recited in claim 15 wherein said operational data includes data altering the frequency of said RF surveillance response signal generated by said transponder tag.

21. The method recited in claim 15 wherein said operational data includes data altering the frequency of said RF surveillance excitation signal to which said transponder tag responds.

22. The method recited in claim 15 wherein said operational data includes data altering the type of modulation used by said transponder tag to generate said RF surveillance response signal.

23. The method recited in claim 15 wherein said RF surveillance response signal is substantially free of data.

24. The method recited in claim 15 wherein said RF surveillance response signal has a frequency of at least about one quarter the frequency of said RF surveillance excitation signal.

25. The method recited in claim 15 wherein said RF surveillance response signal has a frequency about equal to one half the frequency of said RF surveillance excitation signal.

26. A method for monitoring the removal of an article from a controlled area comprising:

connecting a transponder tag to an article in a controlled area;

positioning a tag exciter at an exit leading from said controlled area;

generating an RF surveillance excitation signal with said tag exciter;

activating said transponder tag with said RF surveillance excitation signal when said transponder tag passes said tag exciter in the absence of removal authorization for said article;

generating an RF surveillance response signal with said activated transponder tag in response to said RF surveillance excitation signal, wherein said RF surveillance response signal has a frequency of at least about one quarter the frequency of said RF surveillance excitation signal;

triggering an alarm in response to said RF surveillance response signal; and reprogramming said transponder tag upon removal authorization for said article, wherein said reprogrammed transponder tag does not generate said RF surveillance response signal triggering said alarm when said transponder tag passes said tag exciter.

27. The method recited in claim 26 wherein said RF surveillance response signal is substantially free of data.

28. The method recited in claim 26 wherein said RF surveillance response signal has a frequency about equal to one half the frequency of said RF surveillance excitation signal.

* * * * *